United States Patent [19]

Balinski

[11] Patent Number: 4,584,811

[45] Date of Patent: Apr. 29, 1986

[54] FURRING BRACKET FOR FIREPROOFED BEAMS

[75] Inventor: Henry A. Balinski, Hoffman Estates, Ill.

[73] Assignee: United States Gypsum Company, Chicago, Ill.

[21] Appl. No.: 644,624

[22] Filed: Aug. 27, 1984

[51] Int. Cl.[4] ..... E04C 5/00

[52] U.S. Cl. ..... 52/714; 52/741; 52/241

[58] Field of Search ..... 52/232, 481, 714, 730, 52/364, 367–370, 741–775, 359, 360, 712

[56] References Cited

U.S. PATENT DOCUMENTS

| | | | |
|---|---|---|---|
| 1,674,210 | 6/1928 | Loucks | 52/714 |
| 2,142,165 | 1/1939 | Young et al. | 52/232 |
| 3,748,815 | 7/1973 | Parker | 52/364 |
| 4,152,878 | 5/1979 | Balinski | 52/481 |

OTHER PUBLICATIONS

Sweet's Catalog 1979, Sec. 7–14 Ung, p. 7.

*Primary Examiner*—John E. Murtagh
*Assistant Examiner*—Caroline Dennison
*Attorney, Agent, or Firm*—Robert M. Didrick; Samuel Kurlandsky; Robert H. Robinson

[57] ABSTRACT

Fireproofing of I-beams in building structures is necessary to prevent the loss of strength in the event of a fire. Gypsum board liners for elevator shafts and the like rest in runners attached to the I-beams. Proper placement of the runners is especially critical in the construction of elevator shafts but the correct location of the runners may not be known until after the I-beams have been fireproofed. The furring clip disclosed herein snaps onto the bottom flange of an I-beam and is fireproofed along with the beam. The ceiling runner may be screw attached to the furring clip after the hoistway rails in the elevator shaft are in place.

9 Claims, 3 Drawing Figures

FURRING BRACKET FOR FIREPROOFED BEAMS

This invention relates to a method for attaching runners to steel beams having a sprayed fireproofing coating. The invention relates particularly to the use of a special furring bracket as a connector between the fireproofed beam and the runner. The invention relates more particularly to a furring bracket that may be attached to the beam before fireproofing is sprayed on the beam and serve as a base for the attachment of the runner when the proper location of the runner can be determined.

The use of gypsum board in the construction of the walls surrounding an elevator shaft or the like is becoming increasingly popular. The construction of such walls is described in U.S. Pat. Nos. 3,702,044 and 4,152,878, both of which are incorporated herein by reference, particularly the disclosures at column 4, line 9 to column 5, line 31 of the U.S. Pat. No. 3,702,044 and at column 4, line 42 to column 5, line 28 of the U.S. Pat. No. 4,152,878. A problem exists, however, when the ceiling runners which serve as a tracks into which the gypsum boards are placed must be attached to fireproofed steel beams. The fireproofing material is often sprayed on to a thickness of 2 inches. THe long power pins needed to fasten a runner to a beam covered with 2 inches of fireproofing may ricochet or bend before reaching the beam. Because of this, the U.S. Gypsum Company, assignee of the aforementioned patents, requires that the runners be attached to the beams before the fireproofing is sprayed on. This procedure is satisfactory except when elevator door frames are part of the shaft wall. The proper location of the runner in such a case is very critical and usually can not be known until the elevator car rails are installed or their position is otherwise known. Unfortunately, the installation of the car rails always seems to occur after the fireproofing is in place. Too often, the pre-attached runners are not properly located and must be removed and replaced. The fireproofing is damaged during the removal of the runner and to the cost of replacing the runner there is added the cost of repairing the layer of fireproofing.

Another problem arising from the attachment of the runners to the beams before the spraying of fireproofing is that the runner becomes clogged with the fireproofing material and can not perform its function until it is closed out. A further problem associated with the spraying of fireproofing material onto steel beams in general is the difficulty of applying a uniformly thick layer. The thickness sometimes varies from as little as $\frac{3}{4}$ inch up to the desired 2 inches.

It is an object of this invention to provide a furring bracket which may be attached to a steel beam prior to the fireproofing of the beam so that the installation of a runner or the like is facilitated.

It is a related object of this invention to provide a furring bracket for steel beams which serves also as a thickness gauge during the spraying of fireproofing material onto the beam.

It is a further object of this invention to provide a construction system for cavity shaft walls supported by fireproofed steel beams.

It is another object of this invention to provide a method for building a cavity shaft wall in a building supported by fireproofed steel beams.

Other objects, features, and advantages of this invention will become apparent from the following detailed description and the attached drawings, wherein.

Figure 1:
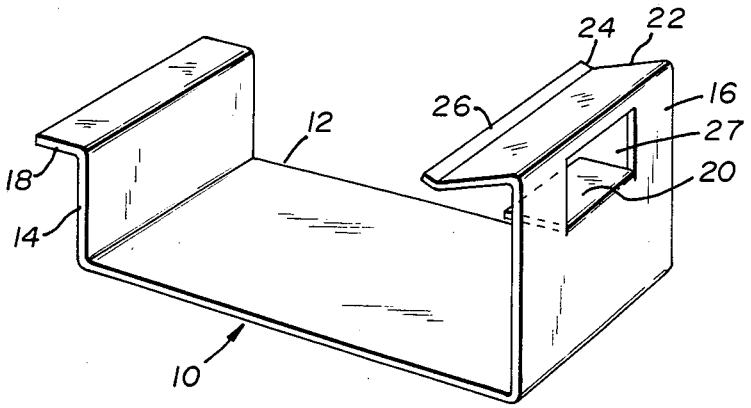
FIG. 1 is a perspective view of the furring bracket of this invention.

In FIG. 1, the generally channel-shaped furring bracket 10 has a horizontal web portion 12, an upright first leg 14 extending perpendicularly from one edge of the web 12, an upright second leg 16 extending perpendicularly from the opposite edge of the web 12 and beyond the first leg 14, a shoulder 18 extending parallel to the web 12 from the edge of the first leg 14 and away from the second leg 16, a tab 20 coplanar and co-directional with the shoulder 18 struck out from the second leg 16, and a clamp 22 extending angularly toward the web 12 from the edge of the second leg 16 to a plane spaced apart from but parallel to the plane of the tab 20. The clamp 22 is terminated by a lip 24 extending from its longitudinal edge 26 at an oblique angle to the clamp.

Figure 2:
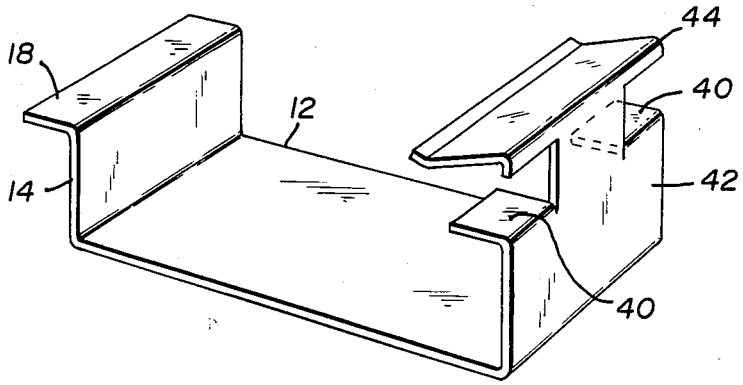
FIG. 2 is a perspective view of a modification of the furring bracket of FIG. 1.

The furring bracket of FIG. 2 is similar to that of FIG. 1 except that the tab 20 is replaced by the two tabs 40 which are shear formed from the leg 42 and the clamp 44 is formed from the remainder.

Figure 3:
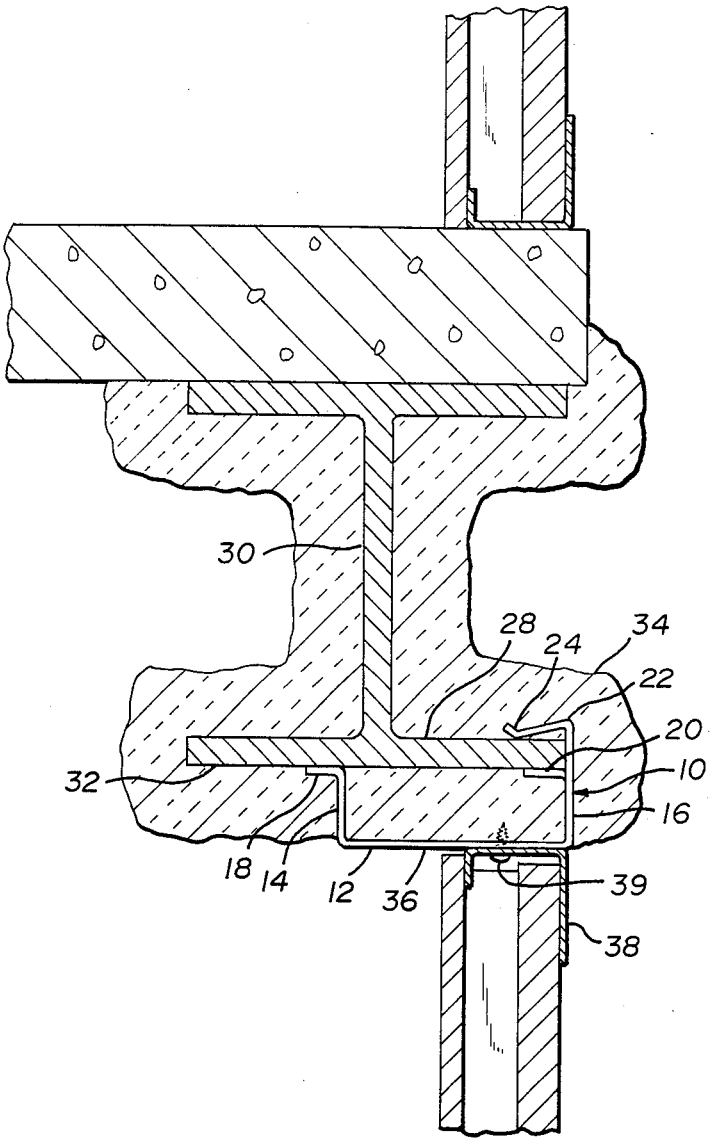
FIG. 3 is a fragmentary cross-section of the construction system of this invention.

The longitudinal edge 26 of the clamp 22 and the tab 20 define a slot 27 which receives a flange 28 of an I-beam 30 as shown in FIG. 3. A plurality of furring brackets thus may be snapped onto the flange 28 and moved into the desired places before the legs 16 and the shoulders 18 are fastened to the flange 32 by welding, power shot fasteners or other conventional means. The shoulder could be fastened to the flange 28 in like manner. A layer 34 of fireproofing material covers the beam 30 and all of the furring bracket 10 except the obverse surface 36 of the web 12. A runner 38 is fastened to the furring bracket 10 by the screw 39 or by welding.

The furring brackets 10 are spaced along the beam 30 at a maximum inteval of 24 inches o.c. The clamp 22 and the tab 20 are pushed onto the flange 28 and the shoulder 18 and the leg 16 are fastened to the beam 30 by, for example, MIG welding. The fireproofing material is then sprayed over the entire beam and the furring brackets 10 as stated above. The spaced between the beam 30 and the web 12 of the furring bracket 10 is used as a guide for the applicator to judge the depth of the fireproofing layer. The length of the leg 14 is preferably about 2 inches to aid in the compliance with the requirement of many building codes that the fireproofing be at least 2 inches thick.

The runner 38 may then be placed in the appropriate position with reference, in the construction of a shaft wall for an elevator shaft for example, the hoistway support rails. When properly located, the runner is fastened to each furring bracket 10 in the conventional manner such as with sheet metal screws 39.

While for the purpose of illustration, representation embodiments of the invention have been shown and described, other embodiments of the invention within the scope of the follwoing claims may become apparent to those skilled in the art.

The subject matter claimed is:

1. A construction system for a cavity shaft wall, said system comprising:

a steel beam and a generally channel-shaped furring bracket fastened to the beam;

said beam comprising an upright web, and a pair of laterally opposing flanges extending at right angles from the upright web;

said furring bracket comprising a horizontal web portion, an upright first leg entending from one edge of the horizontal web, a horizontal shoulder extending from the upper margin of the leg, an upright second leg extending from the opposite edge of the horizontal web and beyond the first leg, a clamp extending angularly toward the horizontal web and the first leg from the upper margin of the second leg, and a tab struck out from the second leg and extending laterally toward but falling short of the first leg in the plane of the shoulder;

the clamp and the tab defining a slot wherein a flange of the steel beam rests and the shoulder of the furring bracket being fastened to a flange of the beam.

2. The construction system of claim 1 wherein the shoulder is co-directional with the tab.

3. The construction system of claim 1 characterized further in that a runner is fastened to the horizontal web of the furring bracket.

4. The construction system of claim 1 wherein the thickness of the fireproofing cover is substantially equal to the distance between the horizontal web and the tab of the furring bracket.

5. The construction system of claim 1 further comprising a fireproofing material sprayed onto all of the surfaces of the beam and the furring bracket except the obverse surface of the horizontal web.

6. A furring bracket adapted to be mounted on an I-beam, said bracket comprising a web portion, a first leg extending perpendicularly from one edge of the web, a shoulder extending from the distal edge of the first leg in a plane parallel to the plane of the web, a second leg extending perpendicularly from the opposite edge of the web and beyond the first leg, a clamp extending angularly toward the web and the first leg from the distal edge of the second leg, and a tab struck out from the second leg and extending laterally toward but falling short of the first leg in the plane of the shoulder.

7. The furring bracket of claim 6 wherein the shoulder and the tab are co-directional.

8. A method for incorporating a fireproofed I-beam into a cavity shaft wall, said method comprising:

mounting a plurality of generally channel-shaped furring brackets on a flange of the I-beam;

each furring bracket comprising a horizontal web, an upright first leg extending from one edge of the horizontal web, a horizontal shoulder extending from the upper margin of the first leg, an upright second leg extending from the web, a horizontal shoulder extending from the upper margin of the first leg, an upright second leg extending from the opposite edge of the horizontal web, a clamp extending angularly from the upper margin of the second leg toward the first leg, and a tab extending from the second leg toward the first leg in the plane of the shoulder;

by sliding the clamp and the tab of each bracket over a flange of the I-beam and fastening the shoulders to a flange of the beam;

spraying a layer of fireproofing material onto all exposed surfaces of the beam and brackets except the obverse surface of each horizontal web;

fastening a runner to the horizontal webs of the brackets; inserting a stud having parallel first, second and third flanges into the runner;

sliding a shaft liner panel between the first and second flanges of the stud in abutting relationship to both flanges; and attaching a panel to the third flange.

9. The method of claim 8 wherein each furring bracket consists essentially of a horizontal web, an upright first leg extending from one edge of the horizontal web, a horizontal shoulder extending from the upper margin of the first leg, an upright second leg, longer than the first leg, extending from the opposite edge of the horizontal web, a clamp extending angularly from the upper margin of the second leg toward the horizontal web and the first leg, and a tab struck out from the second leg and extending part of the way toward the first leg in the plane of the shoulder.

* * * * *

UNITED STATES PATENT AND TRADEMARK OFFICE

CERTIFICATE OF CORRECTION

PATENT NO. : 4,584,811
DATED : April 29, 1986
INVENTOR(S) : Henry A. Balinski

It is certified that error appears in the above—identified patent and that said Letters Patent is hereby corrected as shown below:

IN THE SPECIFICATION:

Column 1, line 49, change the first word "closed" to --cleaned--.

Signed and Sealed this

*Twelfth* Day of *August 1986*

[SEAL]

*Attest:*

DONALD J. QUIGG

*Attesting Officer*

*Commissioner of Patents and Trademarks*